US007108143B1

(12) United States Patent
Lin

(10) Patent No.: US 7,108,143 B1
(45) Date of Patent: Sep. 19, 2006

(54) SLIDING RAIL ASSEMBLY FOR WIRE BASKET

(76) Inventor: Ruei-Hsing Lin, 5F, No. 8, Sec. 1, Chung Hsing Rd., Wu Ku Hsiang, Taipei Hsien (TW)

( * ) Notice: Subject to any disclaimer, the term of this patent is extended or adjusted under 35 U.S.C. 154(b) by 0 days.

(21) Appl. No.: 11/077,002

(22) Filed: Mar. 11, 2005

(51) Int. Cl.
*A47F 5/00* (2006.01)

(52) U.S. Cl. ..... 211/183; 211/162; 211/126.15; 312/330.1; 312/334.1

(58) Field of Classification Search ..... 211/183, 211/162, 126.15, 133.5, 94.01, 94.02, 181.1; 312/330.1, 334.1, 334.4
See application file for complete search history.

(56) References Cited

U.S. PATENT DOCUMENTS 2,928,696 A * 3/1960 Hiers ..... 384/19
5,086,936 A * 2/1992 Remmers ..... 211/126.15
5,303,997 A * 4/1994 Kropf ..... 312/334.4
5,330,063 A * 7/1994 Remmers ..... 211/162
5,375,922 A * 12/1994 Brustle et al. ..... 312/334.4
5,407,084 A * 4/1995 Remmers ..... 211/183
6,491,173 B1 * 12/2002 Costa ..... 211/126.15
6,626,509 B1 * 9/2003 Remmers ..... 312/334.7
6,840,593 B1 * 1/2005 Remmers ..... 312/330.1
6,938,784 B1 * 9/2005 Yang ..... 312/330.1
2003/0111436 A1 * 6/2003 Basinger et al. ..... 211/183

* cited by examiner

*Primary Examiner*—Richard E. Chilcot, Jr.
*Assistant Examiner*—Lindsay M. Maguire
(74) *Attorney, Agent, or Firm*—Leong C. Lei

(57) ABSTRACT

A sliding rail assembly for wire baskets is provided. The rail of the sliding rail assembly has an enlarged opening in the front so that a wire basket could be guided into the rail quickly and easily. A number of wheel members are installed along the bottom of the rail to provide both support and sliding functions to the wire basket, and much less abrasion and squeaking noise is generated when the wire basket is pushed or pulled along the rail. Specially designed blocking members are installed along the rail so as to prevent the wire basket from being pulled entirely out of the rail, or being pushed too far into the rail.

2 Claims, 6 Drawing Sheets

SLIDING RAIL ASSEMBLY FOR WIRE BASKET

BACKGROUND OF THE INVENTION (a) Technical Field of the Invention

The present invention generally relates to storage devices, and more specifically to a sliding rail assembly for supporting wire baskets in a closet.

(b) Description of the Prior Art

Wire baskets are commonly found under kitchen units and in storage and tool closets for the organization of various items. As shown in FIG. 8, the top rim A11 of a conventional wire basket A1 is engaged by sliding on a supporting rail A21 or within a sliding rail of a rail frame A2.

Usually the supporting rail A21 and the sliding rail of the rail frame A2 are designed simply to support the wire basket A1 and often found to have the following shortcomings. First, the top rim A11 of the wire basket A1, the supporting rail A21, and the sliding rail of the rail frame A2 are quickly abraded from the constant sliding movement of the wire basket A1. In addition, there are usually unpleasant loud squeaking noises when the wire basket A1 is slid.

Secondly, when the wire basket A1 is loaded with heavy items, the sliding movement of the wire basket A1 becomes more difficult from the increased friction. The heavy weight would also cause even more severe abrasion.

Thirdly, as there is no positioning mechanism in the design of the conventional wire basket A1, the supporting rail A21, and the rail frame A2, the wire basket A1 could be pulled entirely out or pushed too far into the rail, increasing its difficulty of use. Further more, if the wire basket A1 is filled with sharp knives or heavy tools, pulling out the entire wire basket A1 could pose a security hazard to the users, especially children.

SUMMARY OF THE INVENTION

The primary purpose of the present invention is to provide a sliding rail assembly to obviate the foregoing shortcomings of conventional approaches. The present invention could also be applied to any similar baskets, drawers, or bins.

One of the major characteristics of the present invention is that the rail of the present invention has an enlarged opening in the front so that a wire basket could be guided into the rail quickly and easily.

Another major characteristic of the present invention is that wheel members are installed along the bottom of the rail to provide both support and sliding functions to the wire basket. It is therefore much less abrasion and squeaking noise are generated when the wire basket is pushed or pulled along the rail. One additional wheel member is installed at the top of the rail in a front section to help guiding the wire basket gradually into a horizontal position.

A third characteristic of the present invention is that specially designed blocking members are installed along the rail so as to prevent the wire basket from being pulled entirely out of the rail, or being pushed too far into the rail.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
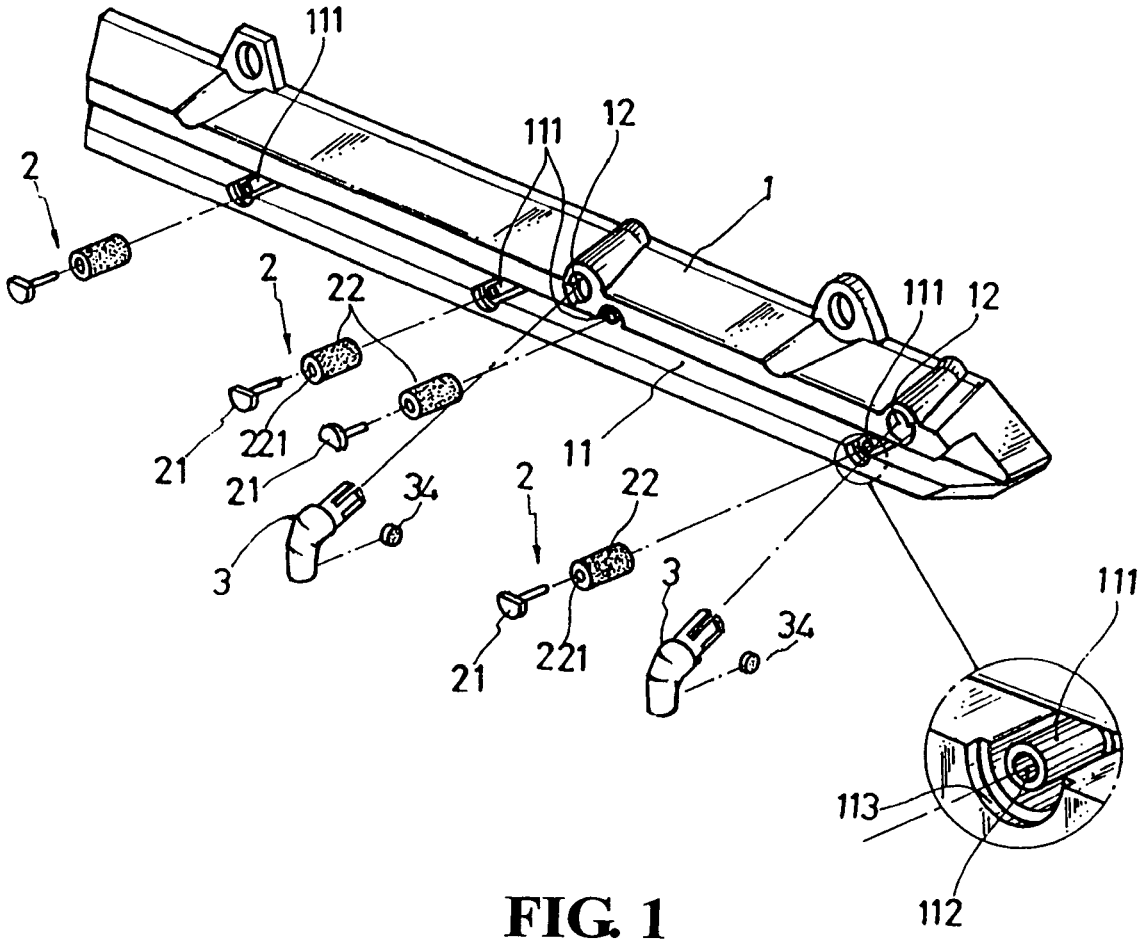
FIG. 1 is a perspective view of the sliding rail assembly according to an embodiment of the present invention.
Figure 2:
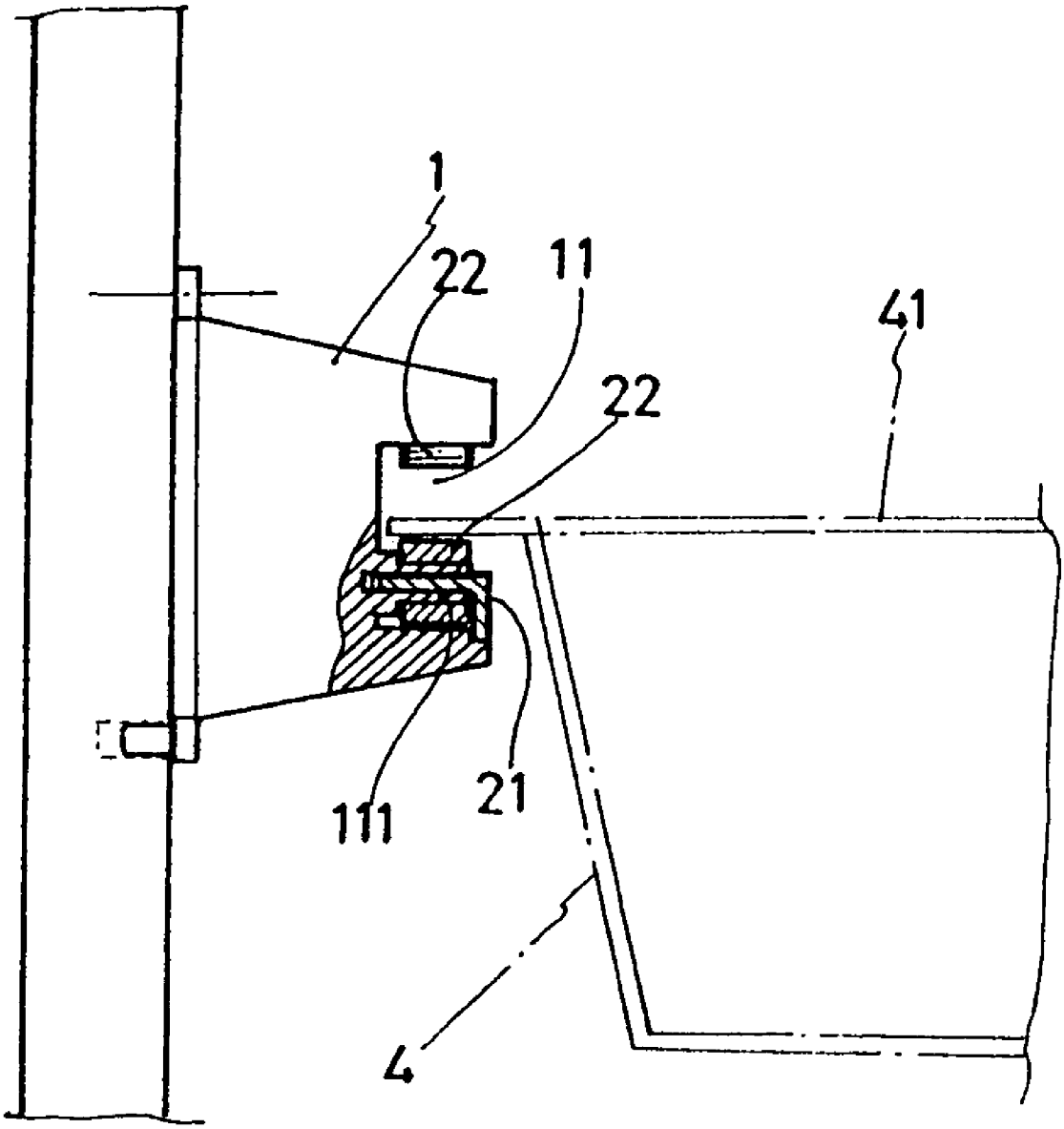
FIG. 2 is a cross-sectional view of the sliding rail assembly according to an embodiment of the present invention.

With reference to FIG. 1, a sliding rail assembly according to an embodiment of the present invention contains a rail 1, a number of wheel members 2, and a number of blocking members 3. In real-life applications, just like conventional approaches, a pair of the rails 1 are installed in a symmetrical fashion at the same height on the left and right inner walls of a closet respectively (based on a user standing in front of the closet), with their channels 11 facing each other (this side of the rails 1 are referred to as the inner side of the rails 1). The channel 11 is arranged along the length of the rail 1 and has a "]" cross-sectional shape (whose opening faces toward the inner side of the rail 1). The top rim 41 of a wire basket 4 could be engaged by sliding within the channels 11 of the rails 1 and could rest on the bottom of the channel 11, as also shown in FIG. 2.

As illustrated in FIG. 1, the channel 11 of the rail 1 has an enlarged opening in the front end (the end closer to the user) so that the top rim 41 of the wire basket 4 could be guided into the channel 11 quickly. Along the channel 11, there are a number of wheel members 2 for the support and sliding movement of the wire basket 4. Then, each of the middle and front sections of the rail 1 has a blocking member 3 to stop and position the wire basket 4 when it is pulled out or pushed in. More details are illustrated in FIGS. 6 and 7.

In the present embodiment, a wheel member 2 is installed at the top of the channel 11 within the front section of the channel 11. This wheel member 2 helps to guide the wire basket 4 into a horizontal position after the wire basket 4 is pushed into the channel 11 through the enlarged opening for a short distance. The other wheel members 2 are installed at the bottom of the channel 11. Each of the wheel members 2 contains a pin 21 having a semi-circular head and a cylindrical roller 22. As shown in the enlarged view of FIG. 1, channel 11 has a number of semi-circular troughs (not numbered). Within each trough, there is a cylindrical axle 111 extended from the interior of the rail 1 along the trough's axial direction. The cylindrical roller 22 has a through hole 221 along its axial direction so that the cylindrical roller 22 could be slid around the cylindrical axle 111. The pin 21 could then be inserted into a though through hole 112 in the axial direction of the axle 111. The trough has a larger opening at the inner side of the rail 1 and the semi-circular head of the pin 21 is sized such that it could fit perfectly into the opening of the trough 113 and the semi-circular head is parallel to the inner side of the rail 1. The trough and the axle 111 are arranged such that the cylindrical roller 22 is slightly above the bottom of the channel 11 to support the wire basket 4's sliding movement.

Figure 3:
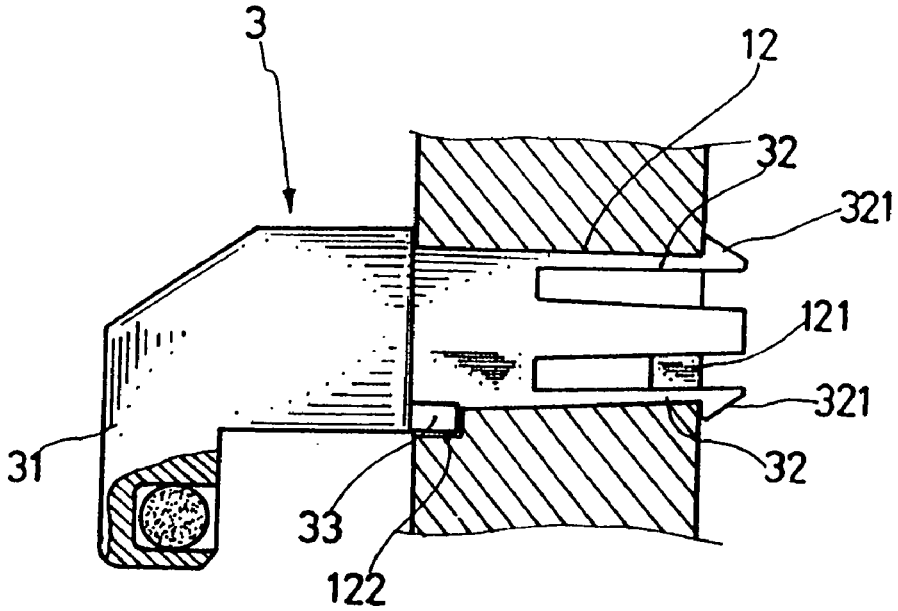
FIG. 3 is a cross-sectional view of the blocking member according to an embodiment of the present invention.
Figure 4:
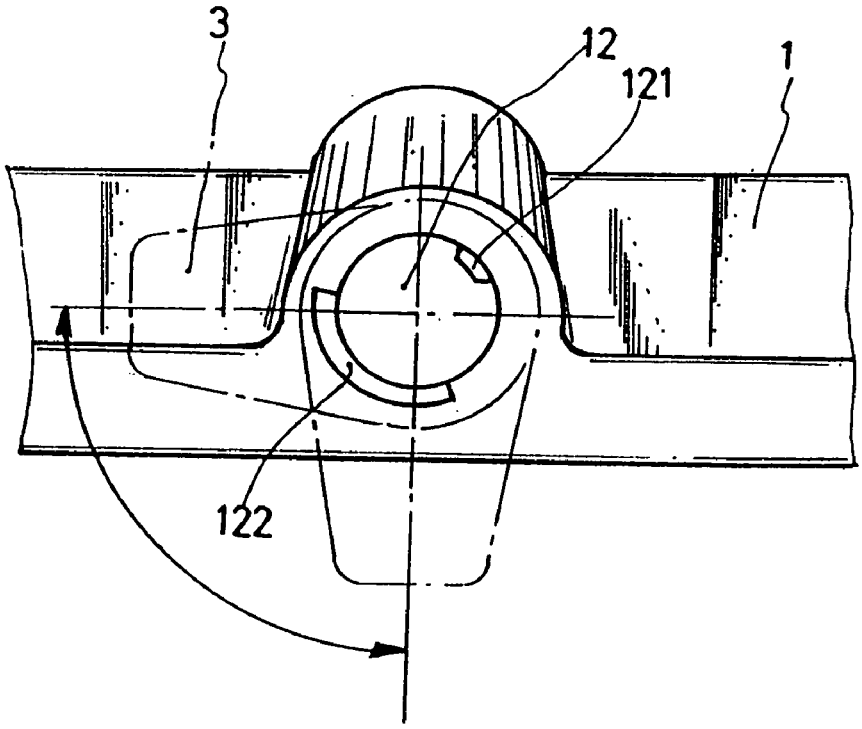
FIG. 4 is a front cross-sectional view of the through hole for fixing a blocking member in the front section of the rail according to an embodiment of the present invention.
Figure 5:
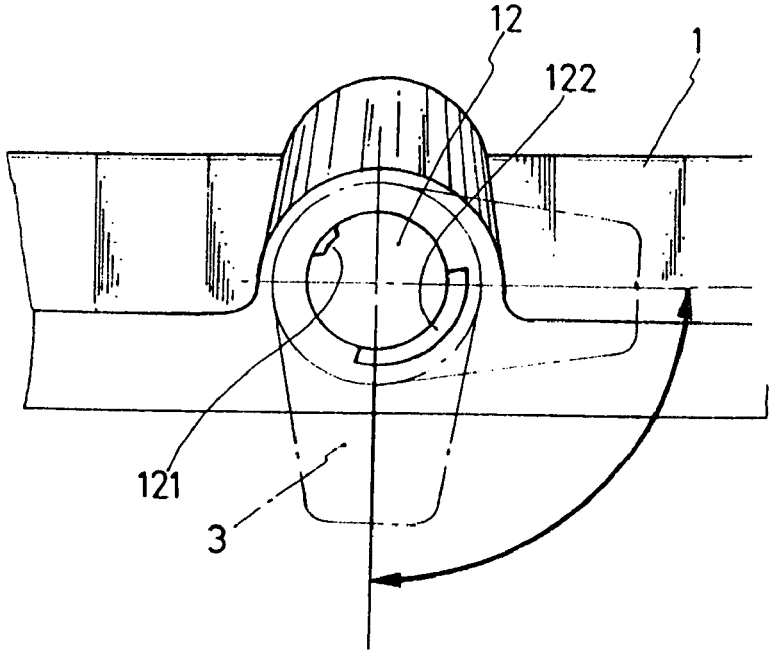
FIG. 5 is a front cross-sectional view of the through hole for fixing a blocking member in the middle section of the rail according to an embodiment of the present invention.

As shown in FIGS. 1, 3, 4, and 5, the blocking members 3 are installed in through holes 12 located at the top of the rail 1 within a front and middle sections of the rail 1. As illustrated in FIG. 3, the blocking member 3 contains a rotating L-shape head 31 and a bayonet 32 having a number of legs 321. When the blocking member 3 is screwed into the through hole 12 from the inner side of the rail 1, a positioning block 121 at a location farther into the through hole 12 and on the inside wall of the through hole 12 would fit within a gap between two adjacent legs 321. The feet of the legs 321 would lock to the outer side of the rail 1. Around the rim of the through hole 12 at the inner side of the rail 1, there is a confining groove 122 that extends about 90 degrees. In conjunction with a confining block 33 of the L-shape head 31 (located at the intersection of the L-shape head 31 and the bayonet 32), the rotation of the L-shape head 31 are confined within the span of the confining groove 122. For the through hole 12 in the front section of the rail 1, its confining groove 122 is arranged in the 3 o'clock to 6 o'clock range as shown in FIG. 5. For the through hole 12 in the middle section of the rail 1, its confining groove 122 is arranged in the 6 o'clock to 9 o'clock range as shown in FIG. 4.

Figure 6:
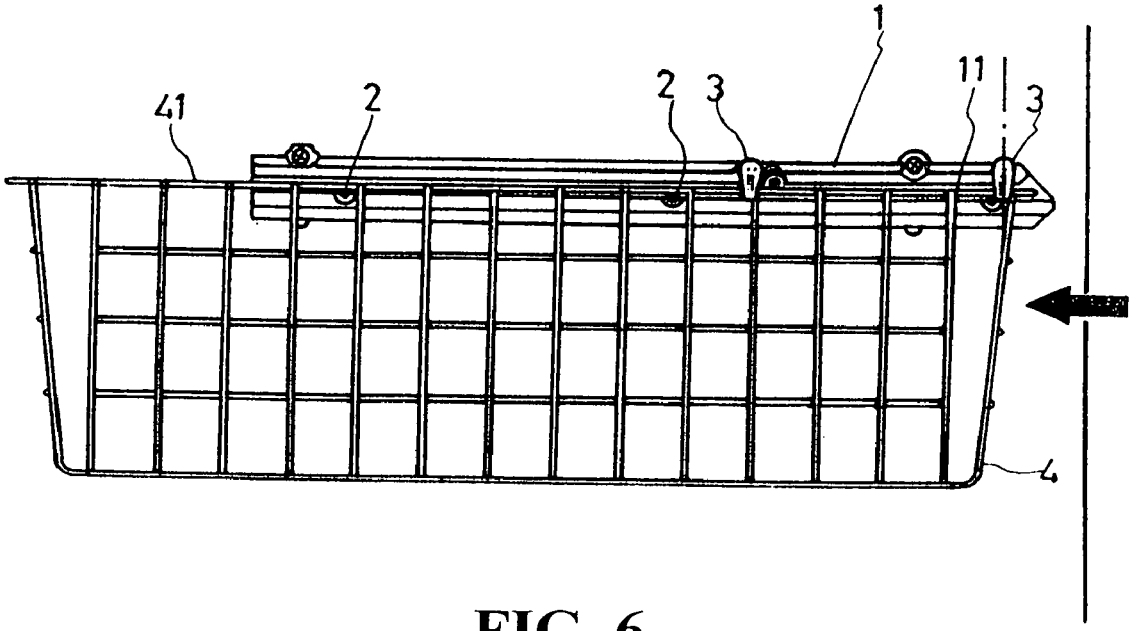
FIG. 6 is a side view showing a wire basket rests in the rail according to an embodiment of the present invention.
Figure 7:
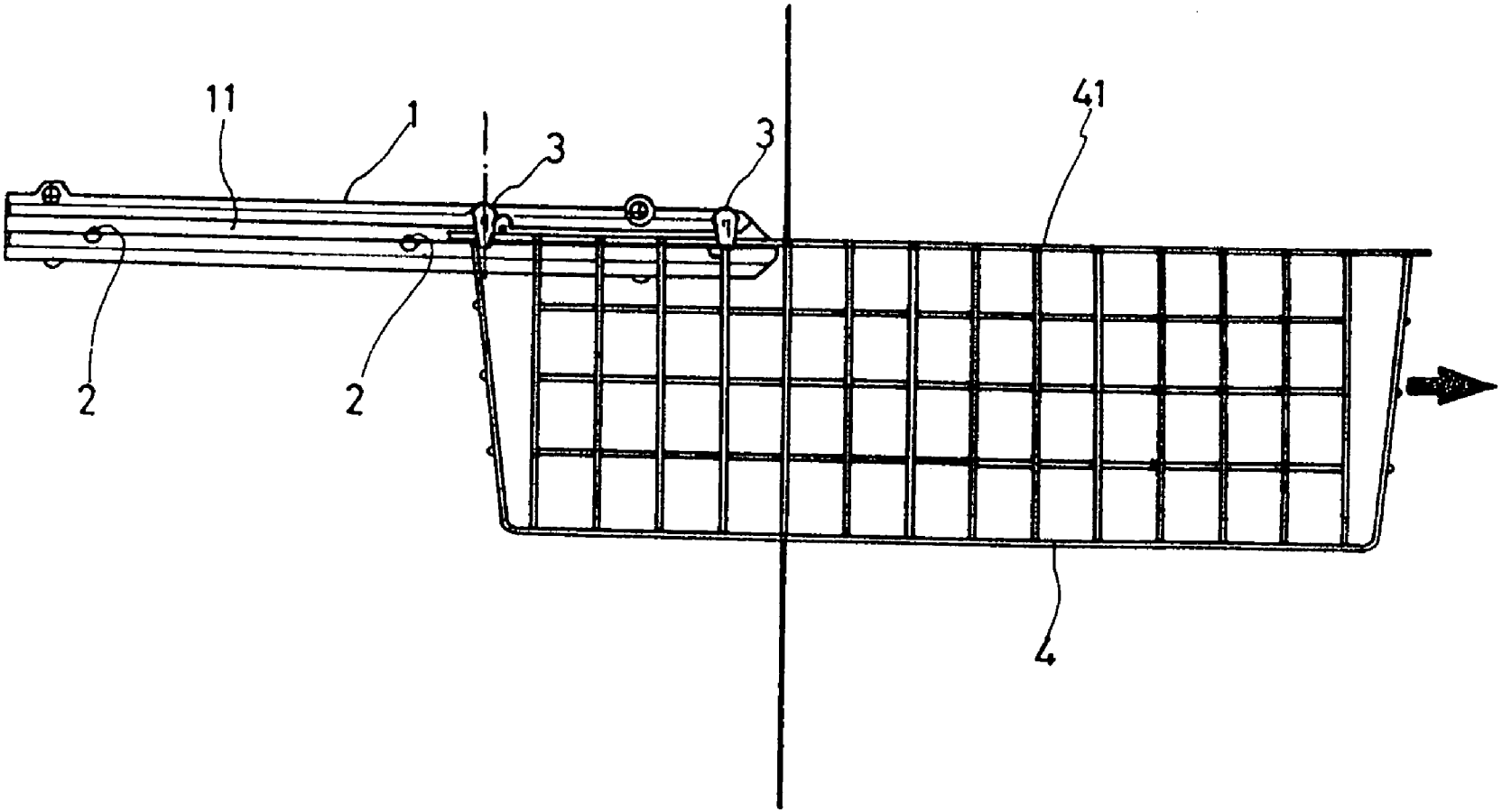
FIG. 7 is a side view showing a wire basket pulled out from the rail according to an embodiment of the present invention.
Figure 8:
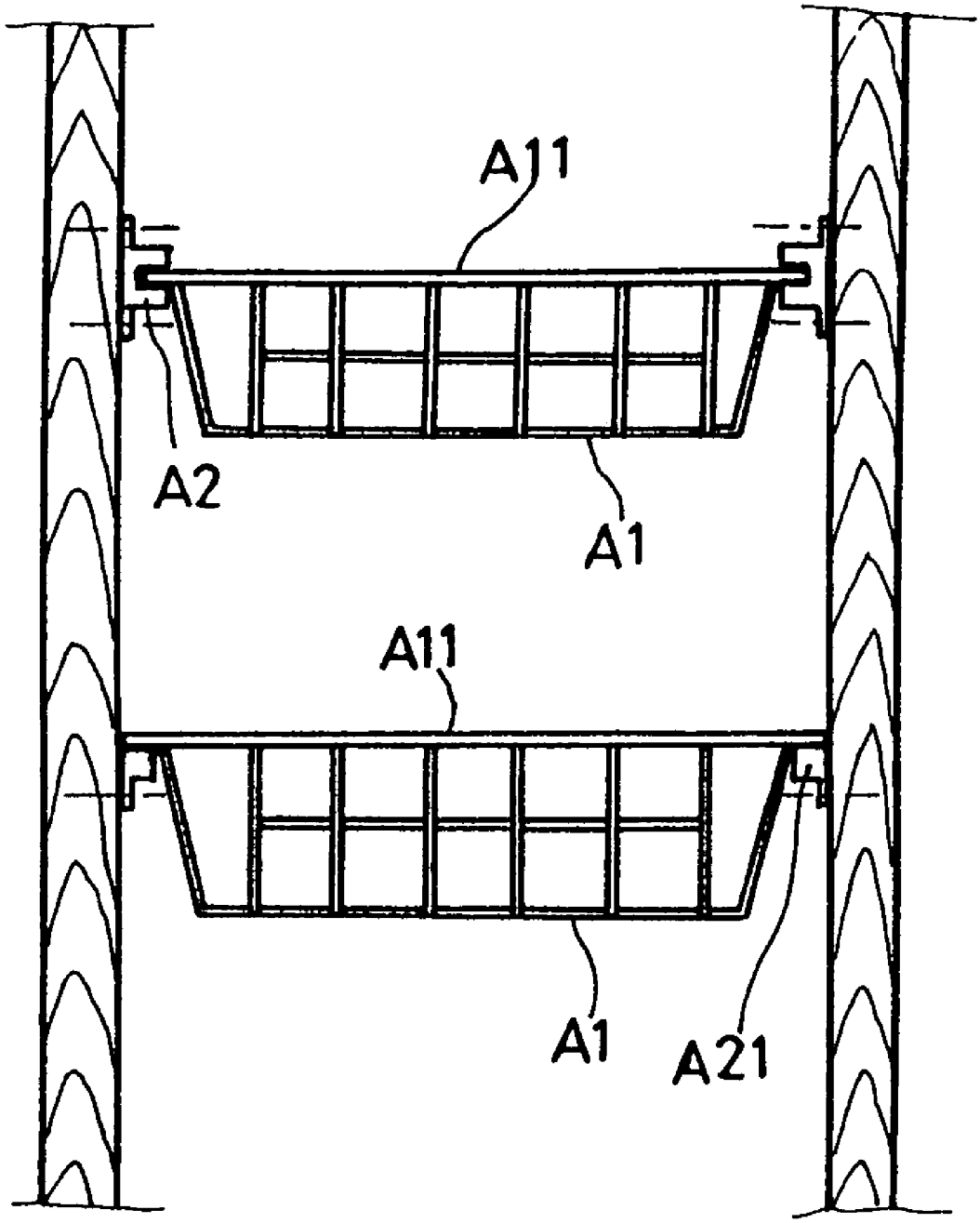
FIG. 8 is a schematic diagram showing a wire basket supported by conventional supporting rail and sliding rail.

As illustrated in FIGS. 6 and 7, when the L-shape heads 31 of the blocking members 3 are rotated to be perpendicular to the rail 1, the front rim 41 of the wire basket 4 would be stopped by the blocking member 3 in the front so that the wire basket 4 couldn't be pushed further into the rail 1. On the other hand, the rear rim 41 of the wire basket 4 would be stopped by the blocking member 3 in the middle so that the wire basket 4 couldn't be pulled further out from the rail 1. On the L-shape heads 31 of the blocking members 3, a magnetic element 34 could be installed at a location where it could contact the rim 41 of the wire basket 4. In other words, the magnetic element 34 of the front blocking member 3 faces to the front while the magnetic element 34 of the middle blocking member 3 faces to the rear. The blocking members 3 therefore effectively prevent the wire basket 4 to be pulled entirely out or pushed too far into the rail 1. The use of the magnetic elements 34 on the blocking members 3 helps to keep the wire basket 4 in its position (especially when it is empty) so that some slight shake wouldn't knock the wire basket 4 out of its position.

When the wire basket 4 is slid initially into the rail 1 or when the wire basket 4 needs to be pulled out entirely, the L-shape heads 31 are rotated so that they are parallel to the rail 1 and thereby wouldn't get in the way. When the wire basket 4 is installed, the blocking members 3 are rotated so that their L-shape heads 31 are perpendicular to the rail 1 and their blocking function is restored.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sliding rail assembly for a wire basket, a pair of said sliding rail assemblies installed symmetrically at the same height on a left and a right inner walls of a closet respectively, said wire basket slidingly engaged with said sliding rail assemblies in a rear-front direction, said sliding rail assembly comprising a rail, a plurality of wheel members, a plurality of blocking members;

wherein said rail has a channel along said rail's length, said channel has an enlarged opening at said channel's front end, said channel has a plurality of semi-circular troughs along a bottom of said channel and at least a trough at a top of said channel in a front section of said channel, each of said trough has a cylindrical axle extended from an interior of the rail along said trough's axial direction, each of said axle has a through hole along said axle's axial direction, each of said trough has a larger opening at an inner side of said rail, said rail has a plurality of through holes located at the top of said rail within a front and middle sections of said rail, each of said through holes of said rail has a positioning block at a location farther into and on an inside wall of said through holes of said rail, each of said through holes of said rail has a confining groove around a rim of said through holes of said rail at the inner side of said rail, said wheel member further comprises a pin having a semi-circular head and a cylindrical roller, said cylindrical roller has a through hole along its axial direction, said cylindrical roller is slid around said cylindrical axle of said trough, said pin is inserted into said through hole of said axle, said semi-circular head of said pin is sized such that it fits perfectly into said larger opening of said trough and said semi-circular head is parallel to the inner side of said rail, said trough and said axle are arranged such that said cylindrical roller is slightly above the bottom of the channel to support said wire basket's sliding movement; and said blocking member further comprises a rotative L-shape head and a bayonet having a plurality of legs, said bayonet is screwed into said through hole of said rail from the inner side of said rail, said positioning block of said through hole of said rail fits within a gap between two adjacent said legs, feet of said legs lock to an outer side of said rail, said L-shape head has a confining block located at said L-shape head's intersection with said bayonet, the rotation of said L-shape head is confined within span said confining groove of said through hole of said rail in conjunction with said confining block, said blocking member within said front section of said rail, when its L-shape head is perpendicular to said rail, stops a front rim of said wire basket to move into said rail, said blocking member within said middle section of said rail, when its L-shape head is perpendicular to said rail, stops a rear rim of said wire basket to move out of said rail, said L-shape head has a magnetic element at where said L-shape head contacts said rim of said wire basket.

2. The sliding rail assembly for a wire basket according to claim 1, wherein said confining groove of said through hole of said rail located within said front section of said rail is arranged around the 3 o'clock to 6 o'clock range, said confining groove of said through hole of said rail located within said middle section of said rail is arranged around the 6 o'clock to 9 o'clock range.

* * * * *